US009150821B2

(12) United States Patent
Meier et al.

(10) Patent No.: US 9,150,821 B2
(45) **Date of Patent: *Oct. 6, 2015**

(54) HIGHLY CONCENTRATED LIQUID WASHING OR CLEANING COMPOSITION

(71) Applicant: Henkel AG & Co. KGaA, Duesseldorf (DE)

(72) Inventors: Frank Meier, Duesseldorf (DE); Marwa Amraoui, Guengla Tinja Bizerte (TN); Sabine Schuemann, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/574,585

(22) Filed: Dec. 18, 2014

(65) Prior Publication Data

US 2015/0105313 A1 Apr. 16, 2015

Related U.S. Application Data

(63) Continuation of application No. PCT/EP2013/063146, filed on Jun. 24, 2013.

(30) Foreign Application Priority Data

Jun. 27, 2012 (DE) ..... 10 2012 211 028

(51) Int. Cl.

| | |
|---|---|
| ***C11D 1/12*** | (2006.01) |
| ***C11D 1/22*** | (2006.01) |
| ***C11D 1/72*** | (2006.01) |
| ***C11D 1/83*** | (2006.01) |
| ***C11D 9/00*** | (2006.01) |
| ***C11D 10/04*** | (2006.01) |
| ***C11D 3/20*** | (2006.01) |
| ***C11D 17/04*** | (2006.01) |
| *C11D 1/14* | (2006.01) |
| *C11D 1/28* | (2006.01) |
| *C11D 1/29* | (2006.01) |
| *C11D 1/66* | (2006.01) |

(52) U.S. Cl.

CPC ..... *C11D 1/83* (2013.01); *C11D 3/2079* (2013.01); *C11D 10/04* (2013.01); *C11D 17/043* (2013.01); *C11D 1/143* (2013.01); *C11D 1/146* (2013.01); *C11D 1/22* (2013.01); *C11D 1/28* (2013.01); *C11D 1/29* (2013.01); *C11D 1/662* (2013.01); *C11D 1/72* (2013.01)

(58) Field of Classification Search

CPC ..... C11D 1/12; C11D 1/22; C11D 1/662; C11D 1/72; C11D 1/83; C11D 9/00; C11D 10/04

USPC ..... 510/351, 356, 421, 426, 535

See application file for complete search history.

(56) References Cited

U.S. PATENT DOCUMENTS

| | | | | |
|---|---|---|---|---|
| 3,704,228 | A | 11/1972 | Eckert et al. | |
| 4,285,841 | A * | 8/1981 | Barrat et al. | 510/321 |

FOREIGN PATENT DOCUMENTS

| | | | |
|---|---|---|---|
| DE | 4028850 | A1 | 3/1992 |
| EP | 0019315 | A1 | 11/1980 |
| EP | 1516917 | A1 | 3/2005 |
| WO | 2010/019841 | A2 | 2/2010 |

OTHER PUBLICATIONS

PCT International Search Report (PCT/EP2013/063146) dated Sep. 13, 2013.

* cited by examiner

*Primary Examiner* — Brian P Mruk
(74) *Attorney, Agent, or Firm* — P. Scott Smith

(57) ABSTRACT

The application describes a highly concentrated, liquid washing or cleaning agent which contains a) 18 to 35 wt. %, relative to the entire washing or cleaning agent, of anionic surfactant of the sulfonate type selected from the group consisting of $C_{9-13}$ alkylbenzenesulfonates, olefinsulfonates, sulfonated estolides, $C_{12-18}$ alkanesulfonates and mixtures thereof, b) 15 to 25 wt. %, relative to the entire washing or cleaning agent, of nonionic surfactant selected from the group consisting of alkoxylated fatty alcohols, alkoxylated oxo alcohols, alkyl polyglycosides and mixtures thereof, c) 2 to 15 wt. %, relative to the entire washing or cleaning agent, of anionic surfactant of the sulfate type selected from the group consisting of fatty alcohol sulfates, fatty alcohol ether sulfates and mixtures thereof and d) 0.5 to 20 wt. %, relative to the entire washing or cleaning agent, of fatty acid and/or fatty acid soap.

7 Claims, No Drawings

HIGHLY CONCENTRATED LIQUID WASHING OR CLEANING COMPOSITION

FIELD OF THE INVENTION

The present invention generally relates to a highly concentrated liquid washing or cleaning agent with anionic and nonionic surfactants.

BACKGROUND OF THE INVENTION

Given increasing levels of environmental consciousness in industry and among consumers, it is desirable to formulate washing or cleaning agents which are as highly concentrated as possible, can be offered for sale in smaller packages and so generate less waste after the use thereof.

WO 2010/019841 A2, for example, discloses an ultra-concentrated liquid washing or cleaning agent which contains (a) 25 to 60 wt. % of nonionic surfactant, (b) 5 to 30 wt. % of anionic surfactant, (c) 0.5 to 18 wt. % of a cold water dispersion aid and (d) up to 60 wt. % of water.

Today, washing or cleaning agents are offered for sale to consumers in many and varied presentations. In addition to powders and granules, these presentations for example also include liquids, gels or portion packages (tablets or filled pouches).

Portion packages containing liquid washing or cleaning agents are in particular becoming ever more popular, since on the one hand they fulfill the consumer's desire for simplified dispensing and on the other hand an ever increasing number of consumers prefer liquid washing or cleaning agents. In this case too it is desirable to use washing or cleaning agents which are as highly concentrated as possible.

When formulating liquid washing or cleaning agents for packaging in water-soluble pouches care should be taken to ensure that the ingredients of the washing or cleaning agent do not partially or completely dissolve the water-soluble envelope of the pouch before use thereof and so give rise to unwanted leaks.

Stability problems, in particular with regard to the stability of the surfactant system, may also occur in highly concentrated washing or cleaning agents. Highly concentrated washing or cleaning agents (>35 wt. % surfactant) containing large quantities of a surfactant system optimized with regard to stability sometimes exhibit shortcomings in terms of cleaning performance.

It was accordingly an object of the present invention to provide a stable, highly concentrated liquid washing or cleaning agent with good cleaning performance which is also suitable for packaging in a water-soluble envelope.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A storage-stable liquid washing or cleaning agent containing: a) 18 to 35 wt. %, relative to the entire washing or cleaning agent, of anionic surfactant of the sulfonate type selected from the group consisting of $C_{9-13}$ alkylbenzenesulfonates, olefinsulfonates, sulfonated estolides, $C_{12-18}$ alkanesulfonates and mixtures thereof; b) 15 to 25 wt. %, relative to the entire washing or cleaning agent, of nonionic surfactant selected from the group consisting of alkoxylated fatty alcohols, alkoxylated oxo alcohols, alkyl polyglycosides and mixtures thereof; c) 2 to 15 wt. %, relative to the entire washing or cleaning agent, of anionic surfactant of the sulfate type selected from the group consisting of fatty alcohol sulfates, fatty alcohol ether sulfates and mixtures thereof; and d) 0.5 to 20 wt. %, relative to the entire washing or cleaning agent, of fatty acid and/or fatty acid soap.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the present invention is achieved by a liquid washing or cleaning agent containing:

a) 18 to 35 wt. %, relative to the entire washing or cleaning agent, of anionic surfactant of the sulfonate type selected from the group consisting of $C_{9-13}$ alkylbenzenesulfonates, olefinsulfonates, sulfonated estolides, $C_{12-18}$ alkanesulfonates and mixtures thereof, b) 15 to 25 wt. %, relative to the entire washing or cleaning agent, of nonionic surfactant selected from the group consisting of alkoxylated fatty alcohols, alkoxylated oxo alcohols, alkyl polyglycosides and mixtures thereof, c) 2 to 15 wt. %, relative to the entire washing or cleaning agent, of anionic surfactant of the sulfate type selected from the group consisting of fatty alcohol sulfates, fatty alcohol ether sulfates and mixtures thereof and d) 0.5 to 20 wt. %, relative to the entire washing or cleaning agent, of fatty acid and/or fatty acid soap.

It has surprisingly been found that a phase-stable washing or cleaning agent with good cleaning performance can be obtained with the assistance of the selected highly concentrated surfactant system.

The washing or cleaning agent exhibits particularly good cleaning performance and good foaming behavior if the anionic surfactant of the sulfonate type is a $C_{9-13}$ alkylbenzenesulfonate.

It is preferred for the ratio of anionic surfactant of the sulfonate type to nonionic surfactant to range from 1.25:1 to 1:1.25. It is likewise preferred for the ratio of anionic surfactant of the sulfonate type to anionic surfactant of the sulfate type to be greater than 2:1 and/or for the ratio of nonionic surfactant to anionic surfactant of the sulfate type to be greater than 2:1.

In a preferred embodiment of the invention, the washing or cleaning agent is packaged in a water-soluble envelope.

It may be preferred in this embodiment for 20 to 25 g of liquid washing or cleaning agent to be packaged in the water-soluble envelope.

It is preferred for the water-soluble envelope to contain polyvinyl alcohol or a polyvinyl alcohol copolymer. Water-soluble envelopes which contain polyvinyl alcohol or a polyvinyl alcohol copolymer have good stability combined with a sufficiently high water solubility, in particular cold water solubility.

The invention will be explained in greater detail below, inter alia with reference to examples.

The liquid washing or cleaning agent contains various surfactants.

The liquid washing or cleaning agent contains a nonionic surfactant selected from the group consisting of alkoxylated fatty alcohols, alkoxylated oxo alcohols, alkyl polyglycosides, ethoxylated methyl esters of natural fatty acids and mixtures thereof.

Preferably used alkoxylated fatty alcohols are ethoxylated, in particular primary alcohols with preferably 8 to 18 C atoms and on average 4 to 12 mol of ethylene oxide (EO) per mol of alcohol, in which the alcohol residue is linear. In particular, alcohol ethoxylates with 12 to 18 C atoms, for example prepared from coconut, palm, tallow fat or oleyl alcohol, and on average 5 to 8 EO per mol of alcohol are preferred. Preferred ethoxylated alcohols include, for example, $C_{12-14}$ alcohols with 4 EO or 7 EO, $C_{9-11}$ alcohol with 7 EO, $C_{12-18}$ alcohols with 5 EO or 7 EO and mixtures of these. The stated degrees of ethoxylation are statistical averages which, for a specific product, may be an integer or a fractional number. Preferred alcohol ethoxylates have a narrow homologue distribution (narrow range ethoxylates, NRE). In addition or alternatively to these alkoxylated fatty alcohols, it is also possible to use fatty alcohols with more than 12 EO. Examples of these are tallow fatty alcohol with 14 EO, 25 EO, 30 EO or 40 EO. Alkoxylated fatty alcohols containing EO and PO groups together in one molecule may also be used according to the invention.

Oxo alcohols are primary, partially branched higher alcohols which are obtained by oxo synthesis, in which oxo aldehydes or the primary aldol condensation products thereof are converted by catalytic hydrogenation into the corresponding oxo alcohols.

The alkoxylated, preferably ethoxylated, oxo alcohols have a degree of alkoxylation of between 5 and 12. The stated degrees of alkoxylation are statistical averages which, for a specific product, may be an integer or a fractional number. Preferred oxo alcohol ethoxylates have a narrow homologue distribution (narrow range ethoxylates, NRE).

A $C_{13-15}$ oxo alcohol with 7 EO, a $C_{13-15}$ oxo alcohol with 8 EO or a mixture of these two oxo alcohols is preferably used in the liquid washing or cleaning agent.

Alkyl glycosides of the general formula $RO(G)_x$, in which R means a primary straight-chain or methyl-branched aliphatic residue, in particular methyl-branched in position 2, with 8 to 22, preferably 12 to 18 C atoms and G is the symbol which denotes a glycose unit with 5 or 6 C atoms, preferably glucose, may moreover also be used as further nonionic surfactants. The degree of oligomerization x, which indicates the distribution of monoglycosides and oligoglycosides, is any desired number between 1 and 10; x is preferably 1.2 to 1.4.

Further suitable nonionic surfactants are ethoxylated methyl esters of natural fatty acids, such as for example coconut, palm kernel or olive oil fatty acids, with preferably 8 to 18 EO units.

It may be preferred for the liquid washing or cleaning agent solely to contain alkoxylated fatty alcohols as nonionic surfactants.

In a particularly preferred embodiment, the liquid washing or cleaning agent solely contains alkoxylated oxo alcohols as nonionic surfactants.

The total quantity of nonionic surfactant in the liquid washing or cleaning agent amounts to up to 25 wt. % and preferably 16 to 20 wt. %, relative to the entire liquid washing or cleaning agent.

The liquid washing or cleaning agent furthermore contains anionic surfactant of the sulfonate type, the latter selected from the group consisting of $C_{9-13}$ alkylbenzenesulfonates, olefinsulfonates, sulfonated estolides, $C_{12-18}$ alkanesulfonates and mixtures thereof.

Surfactants of the sulfonate type which may here be used are preferably $C_{9-13}$ alkylbenzenesulfonates.

Suitable sulfonated estolides which may be used as a surfactant of the sulfonate type include compounds of the following formula

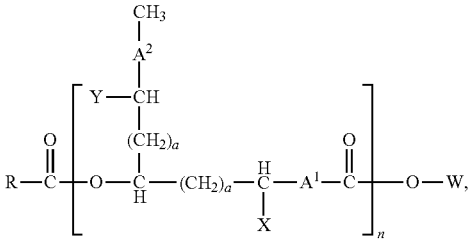

wherein n is an integer from 1 to 30, one of X or Y is $SO_3$—Z and the other is hydrogen, wherein X and Y are present in each repeat unit, $A^1$ and $A^2$ are linear or branched, saturated or unsaturated, substituted or unsubstituted $C_8$-$C_{22}$ alkylene units, a in each repeat unit is independently 0, 1 or 2, R is a linear or branched, saturated or unsaturated, substituted or unsubstituted $C_1$-$C_{24}$ alkyl unit, W is a monovalent or divalent metal cation, an ammonium cation, a substituted ammonium cation, hydrogen, an alkyl group or a substituted alkyl group and Z is hydrogen, a monovalent or divalent metal cation, an ammonium cation or substituted ammonium cation.

The quantity of anionic surfactant of the sulfonate type amounts to 18 to 35 wt. %, preferably 20 to 30 wt. %, in each case relative to the entire washing or cleaning agent.

The washing or cleaning agent furthermore contains 2 to 15 wt. %, preferably 5 to 12 wt. %, in each case relative to the entire washing or cleaning agent, of anionic surfactant of the sulfate type selected from the group consisting of fatty alcohol sulfates, fatty alcohol ether sulfates and mixtures thereof.

Preferred fatty alcohol sulfates are the salts of sulfuric acid semesters of $C_{12}$-$C_{18}$ fatty alcohols, for example obtained from coco fatty alcohol, tallow fatty alcohol, lauryl, myristyl, cetyl or stearyl alcohol. $C_{12}$-$C_{16}$ alkyl sulfates and $C_{12}$-$C_{15}$ alkyl sulfates as well as $C_{14}$-$C_{15}$ alkyl sulfates are preferred because of their washing characteristics.

The sulfuric acid monoesters of straight-chain or branched $C_{7-21}$ alcohols ethoxylated with 1 to 6 mol of ethylene oxide, such as 2-methyl-branched $C_{9-11}$ alcohols with on average 3.5 mol of ethylene oxide (EO) or $C_{12-18}$ fatty alcohols with 1 to 4 EO are for example used as fatty alcohol ether sulfates.

The washing or cleaning agent moreover contains a fatty acid and/or a fatty acid soap. Saturated and unsaturated fatty acids, such as lauric acid, myristic acid, palmitic acid, stearic acid, (hydrogenated) erucic acid and behenic acid and in particular natural fatty acids, for example coconut, palm kernel, olive oil or tallow fatty acids, and soaps or soap mixtures derived from these fatty acids are suitable. The quantity of fatty acid and/or a fatty acid soap in the entire washing or cleaning agent amounts to 0.5 to 20 wt. % and preferably 2 to 15 wt. %.

The anionic surfactants and the fatty acid soaps may be present in the form of the sodium, potassium or ammonium salts thereof. The anionic surfactants are preferably present in the form of the sodium or ammonium salts thereof. The ammonium salts may be the salts of organic bases. The amine used for neutralization is preferably choline, triethylamine, monoethanolamine, diethanolamine, triethanolamine, methylethylamine or a mixture thereof, wherein monoethanolamine is preferred.

The total quantity of nonionic surfactant, anionic surfactant of the sulfonate type, anionic surfactant of the sulfate type and fatty acid (soap) in the liquid washing or cleaning agent amounts to at least 35 wt. %, preferably 40 to 75 wt. %, and particularly preferably 50 to 60 wt. %, in each case relative to the entire liquid washing or cleaning agent.

The liquid washing or cleaning agent may furthermore contain an organic solvent which preferably comprises 1,2-propanediol, glycerol and/or ethanol.

The washing or cleaning agent may contain water, wherein the water content amounts to less than 25 wt. % and more preferably less than 15 wt. %, in each case relative to the entire liquid washing or cleaning agent.

In addition to the nonionic surfactant, the anionic surfactant of the sulfonate type, the anionic surfactant of the sulfate type and the fatty acid (soap), the liquid washing or cleaning agent may contain further ingredients which further improve the applicational and/or esthetic properties of the washing or cleaning agent. For the purposes of the present invention, the washing or cleaning agent preferably additionally contains one or more substances from the group of builders, bleaching agents, bleach catalysts, bleach activators, enzymes, electrolytes, pH adjusting agents, perfumes, perfume carriers, fluorescent agents, dyes, hydrotropes, foam inhibitors, silicone oils, shrinkage prevention agents, anticrease agents, dye transfer inhibitors, antimicrobial active substances, germicides, fungicides, antioxidants, preservatives, corrosion inhibitors, antistatic agents, bitter agents, ironing aids, waterproofing and impregnation agents, skin-conditioning active substances, antiswelling and antislip agents, softening components and UV absorbers.

The liquid washing or cleaning agent may be introduced into a water-soluble envelope and thus be a component of a water-soluble package. If the liquid washing or cleaning agent is packaged in a water-soluble envelope, it is preferred for the content of water to amount to less than 10 wt. %, relative to the entire liquid washing or cleaning agent.

The water-soluble envelope forms a closed structure which, in the interior thereof, has one or more chambers for accommodating one or more washing or cleaning agents.

The water-soluble package may be made dimensionally stable or deformable.

The water-soluble package may assume dimensionally stable form, for example the form of a capsule, box, pot or container.

However, it is in principle also possible and preferable to shape the water-soluble package as a non-dimensionally stable container, for example as a pouch. The shape of such a water-soluble package may be extensively adapted to the circumstances of use. The most varied shapes such as for example tubes, cushions, cylinders, bottles or discs may be considered.

In addition to the liquid washing or cleaning agent, a water-soluble package contains a water-soluble envelope. The water-soluble envelope is preferably formed by a water-soluble film material.

Such water-soluble packages may be produced by either vertical form fill sealing (VFFS) methods or thermoforming methods.

Thermoforming generally includes forming a first layer of a water-soluble film material to produce indentations for receiving a composition, introducing the composition into the indentations, covering the indentations filled with the composition with a second layer of a water-soluble film material and sealing the first and second layers together at least around the indentations.

The water-soluble envelope is preferably made of a water-soluble film material selected from the group comprising polymers or polymer blends. The envelope may be formed of one or of two or more layers of the water-soluble film material. The water-soluble film material of the first layer and further layers, if present, may be identical or different.

It is preferred for the water-soluble envelope to contain polyvinyl alcohol or a polyvinyl alcohol copolymer.

Suitable water-soluble films for producing the water-soluble envelope are preferably based on a polyvinyl alcohol or a polyvinyl alcohol copolymer, the molecular weight of which is in the range from 10,000 to 1,000,000 $gmol^{-1}$, preferably from 20,000 to 500,000 $gmol^{-1}$, more preferably from 30,000 to 100,000 $gmol^{-1}$ and in particular from 40,000 to 80,000 $gmol^{-1}$.

Polyvinyl alcohol is conventionally produced by hydrolysis of polyvinyl acetate, since the direct synthetic pathway is not possible. The same is true of polyvinyl alcohol copolymers, which are accordingly produced from polyvinyl acetate copolymers. It is preferred for at least one layer of the water-soluble envelope to comprise a polyvinyl alcohol having a degree of hydrolysis of 70 to 100 mol %, preferably of 80 to 90 mol %, more preferably of 81 to 89 mol % and in particular of 82 to 88 mol %.

A polymer selected from the group comprising (meth) acrylic acid-containing (co)polymers, polyacrylamides, oxazoline polymers, polystyrenesulfonates, polyurethanes, polyesters, polyethers, polylactic acids or mixtures of the above polymers may additionally be added to a polyvinyl alcohol-containing film material suitable for producing the water-soluble envelope. Polylactic acids are a preferred additional polymer.

In addition to vinyl alcohol, preferred polyvinyl alcohol copolymers comprise dicarboxylic acids as further monomers. Suitable dicarboxylic acids are itaconic acid, malonic acid, succinic acid and mixtures thereof, wherein itaconic acid is preferred.

In addition to vinyl alcohol, likewise preferred polyvinyl alcohol copolymers comprise an ethylenically unsaturated carboxylic acid, the salt thereof or the ester thereof. In addition to vinyl alcohol, such polyvinyl alcohol copolymers more preferably contain acrylic acid, methacrylic acid, acrylic acid esters, methacrylic acid esters or mixtures thereof.

It may be preferred for the film material to contain further additives. The film material may for example contain plasticizers such as dipropylene glycol, ethylene glycol, diethylene glycol, propylene glycol, glycerol, sorbitol, mannitol or mixtures thereof. Further additives comprise for example release aids, fillers, crosslinking agents, surfactants, antioxidants, UV absorbers, antiblocking agents, non-stick agents or mixtures thereof.

Suitable water-soluble films for use in the water-soluble envelopes of the water-soluble packages according to the invention are films which are distributed for example by MonoSol LLC for example under the names M8630, M8310, C8400 or M8900. Other suitable films comprise films known as Solublon® PT, Solublon® GA, Solublon® KC or Solublon® KL from Aicello Chemical Europe GmbH or VF-HP films from Kuraray.

In a preferred embodiment, the water-soluble package has one chamber for accommodating the highly concentrated liquid washing or cleaning agent.

In a further, likewise preferred embodiment, the water-soluble package has two chambers. In this embodiment, the first chamber contains the above-described highly concentrated liquid washing or cleaning agent and the second chamber may contain a solid or a liquid washing or cleaning agent.

If, in a still more preferred embodiment, the water-soluble package has three chambers, these chambers may all in each case contain a liquid washing or cleaning agent. It is, however, also possible for one chamber to contain a solid washing or cleaning agent and two chambers to contain a liquid washing or cleaning agent. It is moreover possible for two chambers to contain a solid washing or cleaning agent and one chamber to contain a liquid washing or cleaning agent.

In water-soluble packages with four or more chambers, there are correspondingly still more possible combinations with regard to the number of chambers with a solid or a liquid washing or cleaning agent.

In the case of water-soluble packages with two or more chambers, at least one of the chambers contains the above-described liquid washing or cleaning agent according to the invention. The liquid washing or cleaning agents which are present in the other chambers of a water-soluble package may have the same composition. The liquid washing or cleaning agents in a water-soluble package with at least two chambers preferably have compositions which differ with regard at least to the content of an ingredient.

The quantity of washing or cleaning agents located in total in the water-soluble package preferably corresponds to the entire dose which is required for a washing cycle for 4.5 kg of laundry. In a preferred embodiment of the invention, 20 to 25 g of liquid washing or cleaning agent are packaged in a water-soluble envelope.

Examples

Liquid washing or cleaning agents were produced using conventional, known procedures and methods. Table 1 below shows the compositions of a washing or cleaning agent according to the invention (Inv. 1) and of a washing or cleaning agent not according to the invention (Comp. 1).

TABLE 1

Liquid washing or cleaning agents Inv. 1 and Comp. 1 [all quantities are stated in wt.% of active substance, relative to the composition]

| Ingredients | Inv. 1 | Comp. 1 |
|---|---|---|
| $C_{10}$-$C_{13}$ alkylbenzenesulfonic acid | 20.8 | 7.2 |
| $C_{13}$-$C_{15}$ oxo alcohol with 8 EO | 18 | — |
| $C_{12-18}$ fatty alcohol with 7 EO | — | 7 |
| Na lauryl ether sulfate (2EO) | 7.2 | 12.8 |
| C12-18 fatty acid | 12 | 5.6 |
| Soil-release polymer* | 2.8 | 1.8 |
| Glycerol | 5.2 | — |
| 1,2-Propanediol | 5.7 | 5.7 |
| Ethanol | 2 | 2 |
| Phosphonate | 2 | 2 |
| Monoethanolamine | 10 | — |
| NaOH (50%) | — | 6.9 |
| Citric acid | 2.2 | 2.3 |
| Boric acid | 1 | 1 |
| Dyes, enzymes (cellulase, amylase & protease), optical brighteners, perfume | 8.8 | 6.3 |
| Water | to 100% | to 100% |

*soil-release polymer = Texcare ® SRN 170 (from Clariant)

In a first washing test, the effectiveness of washing or cleaning agents Inv. 1 and Comp. 1 was determined as the sum of reflectance units on various stains (53 greasy stains and 18 enzyme-sensitive stains). A domestic washing machine (Miele® W 1734) was in each case loaded for this purpose with 3.5 kg of accompanying laundry and correspondingly soiled pieces of cloth. In addition, either 39 g of washing or cleaning agent Comp. 1 or 25 g of washing or cleaning agent Inv. 1 were apportioned and washing was performed at 40° C. After drying by hanging and mangling of the pieces of cloth, the whiteness thereof was determined by spectrophotometry (Minolta® CR200-1). Stain removal was assessed on the basis of the Y value.

It was found that the values obtained in the case enzyme-sensitive stains were virtually identical, while washing or cleaning agent Inv. 1 was more effective on greasy stains than washing or cleaning agent Comp. 1 not according to the invention.

TABLE 2

Effectiveness on various stains

| | Effectiveness on 53 greasy stains | Effectiveness on 18 enzyme-sensitive stains |
|---|---|---|
| Comp. 1 (39 g) | 58.3 | 67.25 |
| Inv. 1 (25 g) | 59.8 | 67.2 |

In a second washing text, the effectiveness of washing or cleaning agents Inv. 1 and Comp. 1 was determined on 53 greasy stains at different washing temperatures. A domestic washing machine (Miele® W 1734) was in each case loaded for this purpose with 3.5 kg of accompanying laundry and correspondingly soiled pieces of cloth. In addition, either 39 g of washing or cleaning agent Comp. 1 or 20 g of washing or cleaning agent Inv. 1 were apportioned and washing was performed at 20° C., 40° C. or 60° C. After drying by hanging and mangling of the pieces of cloth, the whiteness thereof was determined by spectrophotometry (Minolta® CR200-1). Stain removal was assessed on the basis of the Y value.

It was found that washing or cleaning agent Inv. 1 exhibited better effectiveness at all three washing temperatures than washing or cleaning agent Comp. 1 not according to the invention.

TABLE 3

Effectiveness on greasy soiling at different temperatures

| | Effectiveness 20° C. | at Effectiveness 60° C. | at Effectiveness at 60° C. |
|---|---|---|---|
| Comp. 1 (39 g) | 57.7 | 58.3 | 59.0 |
| Inv. 1 (20 g) | 58.6 | 59.8 | 61.6 |

In a third washing test, the graying inhibition performance of washing or cleaning agents Inv. 1 and Comp. 1 was determined. A domestic washing machine (Miele® W 1734) was in case loaded for this purpose with 2.5 kg of white accompanying laundry, various test fabrics, five SBL 2004 cloths with standardized soil loading (32 g soil ballast). In addition, either 39 g of washing or cleaning agent Comp. 1 or 25 g of washing or cleaning agent Inv. 1 or 20 g of washing or cleaning agent Inv. 1 were apportioned and washing was performed at 40° C. After drying by hanging and mangling of the pieces of cloth, the whiteness thereof was determined by spectrophotometry (Minolta® CR200-1). Stain removal was assessed on the basis of the Y value.

Table 4 compares these measured values with the respective initial value for the test fabric.

The cotton fabrics were eight different commercially obtainable cotton fabrics. The polyester fabrics were five different commercially obtainable polyester fabrics. The everyday fabrics were four conventional commercial everyday textiles such as for example kitchen, terry, huckaback weave towels and white T-shirts.

TABLE 4

| Whiteness (mean of the respective test fabric) | | | | |
|---|---|---|---|---|
| Washing or cleaning agent | Cotton | Polyester | Everyday | Total |
| Comp. 1 (39 g) | −10.50 | −4.05 | −13.70 | −9.41 |
| Inv. 1 (25 g) | −8.00 | −3.65 | −13.60 | −8.41 |
| Inv. 1 (20 g) | −8.20 | −3.50 | −12.90 | −8.20 |

The results show that the graying inhibition performance of the washing or cleaning agent Inv. 1 is greater than that of washing or cleaning agent Comp. 1 not according to the invention.

In a fourth washing test, stain removal of washing or cleaning agents Inv. 1 and Comp. 1 was determined on various stains. A domestic washing machine (Miele® W 1734) was in each case loaded for this purpose with 3.5 kg of accompanying laundry and correspondingly soiled pieces of cloth. In addition, either 39 g of washing or cleaning agent Comp. 1 or 25 g of washing or cleaning agent Inv. 1 or 20 g of washing or cleaning agent Inv. 1 were apportioned and washing was performed at 40° C. After drying by hanging and mangling of the pieces of cloth, the whiteness thereof was determined by spectrophotometry (Minolta® CR200-1). Stain removal was assessed on the basis of the Y value.

TABLE 5

| Stain removal | | | |
|---|---|---|---|
| | Comp. 1 (39 g) | Inv. 1 (25 g) | Inv. 1 (20 g) |
| Grass and soil (CO) | 84.7 | 91.8 | 88.7 |
| Mustard (CO) | 87.5 | 94.1 | 94.1 |
| Chocolate dessert (CO) | 76.2 | 96.5 | 85.5 |
| Baby food (CO) | 67.1 | 84.8 | 83.7 |
| Lipstick, Max Factor ® no. 749 (CO) | 36.0 | 53.6 | 42.7 |
| Chocolate mousse (CO) | 57.2 | 63.5 | 62.8 |
| Pink lipstick (CO/PES) | 33.8 | 40.3 | 38.8 |
| Kebab grease (CO) | 91.5 | 98.2 | 98.1 |
| Olive oil (CO) | 82.0 | 89.3 | 84.3 |
| Kebab grease (PES) | 82.1 | 89.3 | 82.9 |

CO = cotton
PES = polyester
CO/PES = cotton-polyester blend fabric

To produce water-soluble packages containing washing or cleaning agent Inv. 1, an M 8630 grade film (from Monosol) with a thickness of 76 μm was drawn by vacuum into a depression to form an indentation. The indentation was then filled with 25 g of liquid washing or cleaning agent Inv. 1. After covering the indentations filled with the agent with a second layer of an M 8630 grade film, the first and second layers were sealed together. The sealing temperature was 150° C. and the sealing duration was 1.1 seconds.

After 4, 8 and 12 weeks' storage of the water-soluble packages containing washing or cleaning agent Inv. 1 under different climatic conditions, no partial or complete dissolution of the water-soluble envelope was to be observed. In addition, no pores or holes which would likewise result in product escaping or leaking out could be identified.

Water-soluble packages containing liquid washing or cleaning agent Inv. 1 dissolved without residue in washing cycles at temperatures in the range from 20 to 95° C.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A storage-stable liquid washing or cleaning agent containing:

a) 18 to 35 wt. %, relative to the entire washing or cleaning agent, of sulfonate anionic surfactant selected from the group consisting of $C_{9-13}$ alkylbenzenesulfonates, olefinsulfonates, sulfonated estolides, $C_{12-18}$ alkanesulfonates and mixtures thereof, b) 15 to 25 wt. %, relative to the entire washing or cleaning agent, of nonionic surfactant selected from the group consisting of alkoxylated fatty alcohols, alkoxylated oxo alcohols, alkyl polyglycosides and mixtures thereof, c) 2 to 15 wt. %, relative to the entire washing or cleaning agent, of a sulfate anionic surfactant selected from the group consisting of fatty alcohol sulfates, fatty alcohol ether sulfates and mixtures thereof and d) 0.5 to 20 wt. %, relative to the entire washing or cleaning agent, of fatty acid and/or fatty acid soap wherein the liquid washing or cleaning agent is packaged in a water-soluble envelope.

2. The liquid washing or cleaning agent according to claim 1, wherein the sulfonate anionic surfactant is a $C_{9-13}$ alkylbenzenesulfonate.

3. The liquid washing or cleaning agent according to claim 1, wherein the ratio of sulfonate anionic surfactant to nonionic surfactant amounts to from 1.25:1 to 1:1.25.

4. The liquid washing or cleaning agent according to claim 1, wherein the ratio of sulfonate anionic surfactant to sulfate anionic surfactant is greater than 2:1.

5. The liquid washing or cleaning agent according to claim 1, wherein the ratio of nonionic surfactant to sulfate anionic surfactant is greater than 2:1.

6. The liquid washing or cleaning agent according to claim 1, wherein water-soluble envelope includes 20 to 25 g of liquid washing or cleaning agent.

7. The liquid washing or cleaning agent according to claim 1, wherein the water-soluble envelope contains polyvinyl alcohol or a polyvinyl alcohol copolymer.

* * * * *